US007076079B2

(12) United States Patent
Chung

(10) Patent No.: US 7,076,079 B2
(45) **Date of Patent: *Jul. 11, 2006**

(54) MULTI-FUNCTIONAL ACTUATOR

(75) Inventor: Seuk Hwan Chung, Suwon-Shi (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 463 days.

This patent is subject to a terminal disclaimer.

(21) Appl. No.: 10/078,074

(22) Filed: Feb. 14, 2002

(65) Prior Publication Data

US 2003/0036364 A1 Feb. 20, 2003

(30) Foreign Application Priority Data

Aug. 17, 2001 (KR) ..... 2001-49519
Nov. 16, 2001 (KR) ..... 2001-71334

(51) Int. Cl.
*H04R 1/00* (2006.01)

(52) U.S. Cl. ..... 381/404; 381/396; 381/406

(58) Field of Classification Search ..... 381/99, 381/182, 372, 396, 400–401, 406, 404; 340/388.1, 340/388.2, 407.1; 455/90, 567

See application file for complete search history.

(56) References Cited

U.S. PATENT DOCUMENTS 6,208,237 B1 * 3/2001 Saiki et al. ..... 340/388.1
6,466,682 B1 * 10/2002 An ..... 381/413
6,487,300 B1 * 11/2002 Lee et al. ..... 381/396
6,560,347 B1 * 5/2003 Chung ..... 381/420
6,611,605 B1 * 8/2003 Kim ..... 381/406
2002/0076068 A1 * 6/2002 Chung ..... 381/150
2003/0044031 A1 * 3/2003 Son ..... 381/182

* cited by examiner

*Primary Examiner*—Sinh Tran
*Assistant Examiner*—Phylesha Dabney
(74) *Attorney, Agent, or Firm*—Darby & Darby

(57) ABSTRACT

Disclosed is a multi-functional actuator comprising: a housing having an internal space and a groove in the inner side; a sound-generating diaphragm with an outer end fixed to the upper end of said housing; a voice coil fixed to the bottom of said diaphragm; a vertically magnetized magnet; an upper plate attached to said magnet for forming a magnet circuit; a yoke for forming the magnetic circuit together with said magnet; a weight for defining a vibration body together with said yoke; a leaf spring fixed into said grooves of the housing and having a portion of curvature; and a vibrating coil installed in said housing for generating vibration using a magnetic flux formed in a magnetic system. A structure that can prevent deformation of the leaf spring before/after dropping to a mobile communication terminal such as mobile telephone and pager is provided thereby to prevent reliability degradation of the actuator in use for the mobile communication terminal and enhance vibration features thereof.

21 Claims, 8 Drawing Sheets

MULTI-FUNCTIONAL ACTUATOR

BACKGROUND OF THE INVENTION

1. Field of the Invention

In general, a multi-functional actuator functions to output an electrically or electronically received voice signal or a previously inputted bell or melody as an audible sound, or a vibration signal as a call-incoming signal. Such a function of the multi-functional actuator has been used in mobile communication devices such as a mobile telephone, a pager and so on, however, since the mobile communication devices are required to be carried always or used in a crowded place, the mobile communication devices can be impacted, i.e., dropped or collided into a hard object regardless of the intention of a user so that deformation can be caused to an internal structure thereof.

Therefore, necessity is increasing for a multi-functional actuator with a structure which can withstand such an unexpected impact.

2. Description of the Related Art

A typical multi-functional actuator used in the mobile communication devices has a configuration as shown in FIG. 1, and is comprised of a housing 8 having an internal space and grooves in the inner side; a diaphragm 1 with an outer end fixed to the upper end of the housing 8; a voice coil 2 fixed to the lower end of the diaphragm 8; a vertically magnetized magnet 4; an upper yoke 3 and a lower yoke 5 attached to the magnet 4 for defining a magnetic system together with the magnet; a weight 6 for defining a vibrating body; a plurality of leaf springs 7 and 9 fixed in the grooves of the housing 8; and a vibration-generating coil 10 installed on the grill in the housing 8 for generating vibration by using a magnetic flux formed in the magnetic system.

In this case, if the mutual position and assembled condition of those components are deformed by an external impact or disturbance, the multi-functional actuator cannot perform its own function.

Therefore, components used in a mobile communication terminal such as a mobile telephone and a pager are dropped in various angles and directions as a preliminary test, and the multi-functional actuator also undergoes a test like this.

In this test, a jig is used in order to apply impacts to the multi-functional actuator as an object article of the test from certain heights, and the article is repeatedly dropped for several times with upper, lower and lateral surfaces facing downward. Here, an opposed dropping surface is adopted as a sheet iron which is made of a hard material so as to generally apply an impact to the article.

When article conditions before and after dropping are inspected in such a test, the typical multi-functional actuator of the prior art shows most of the deformation between the housing 8 and the leaf spring 7 when dropped with the side-surface facing downward, which is caused by a rotational moment M generated along the circumferential direction in spiral shape. FIG. 2 shows a rotational moment like this.

FIG. 3 shows a shape of a general leaf spring, which is fixedly supported by the grooves provided in the inner side of the housing. Here, the leaf spring servers to support the weight and determine the natural frequency of a system together with the mass of the weight thereby influencing the generation of sound and vibration according to an input excitation frequency.

In other words, it is required that the values of the mass m and the spring constant k should not be varied, which are important factors in determining the natural frequency of the system.

SUMMARY OF THE INVENTION

Accordingly, the present invention has been proposed to solve the foregoing problems of the prior art, and it an object of the invention to fix the position of a vibration mass within a multi-functional actuator and thus prevent variation in features of a leaf spring which has an elastic modulous as a factor for determining the natural frequency of a system together with the mass when the mass is under rotation.

Therefore, the present invention provides a structure that can prevent deformation of the leaf spring, so as to avoid reliability degradation of the actuator used in a mobile communication terminal and improve vibration features thereof.

DESCRIPTION OF THE PREFERRED EMBODIMENT

In order to obtain the foregoing object, a multi-functional actuator according to the invention is comprised of a housing having an internal space and grooves in the inner side; a sound-generating diaphragm with an outer end fixed to the upper end of the housing; a voice coil fixed to the bottom of the diaphragm; a vertically magnetized magnet; an upper plate attached to the magnet for forming a magnet circuit; an upper yoke and a lower yoke for forming the magnetic circuit together with the magnet; a weight for defining a vibration body; at least one leaf spring fixed into the grooves of the housing and having portions of curvature; and a vibrating coil arranged on a grill for generating vibration using a magnetic flux formed in a magnetic system.

Hereinafter, detailed description will be made about embodiments of the invention in reference to the accompanying drawings.

Figure 1:
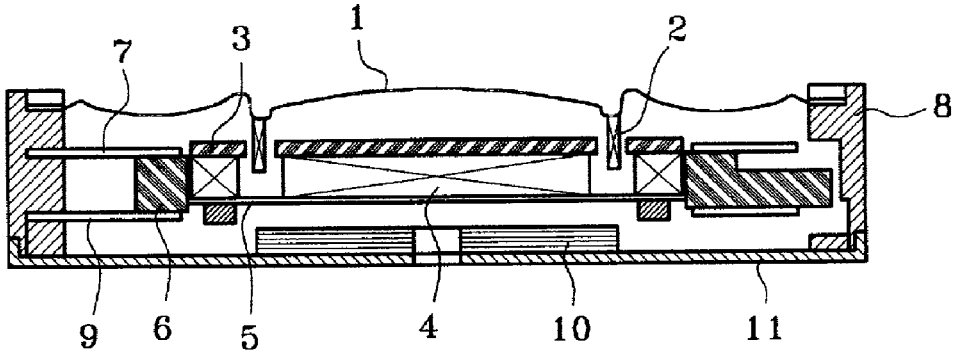
FIG. 1 is a sectional view for illustrating an example of a multi-functional actuator of the prior art.
Figure 2:
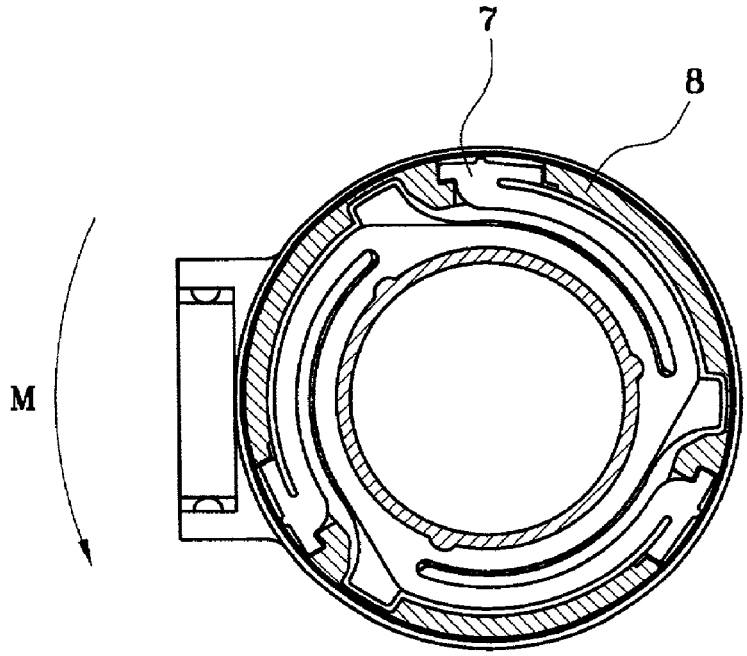
FIG. 2 shows a moment acting along a dropping direction of a typical actuator.
Figure 3:
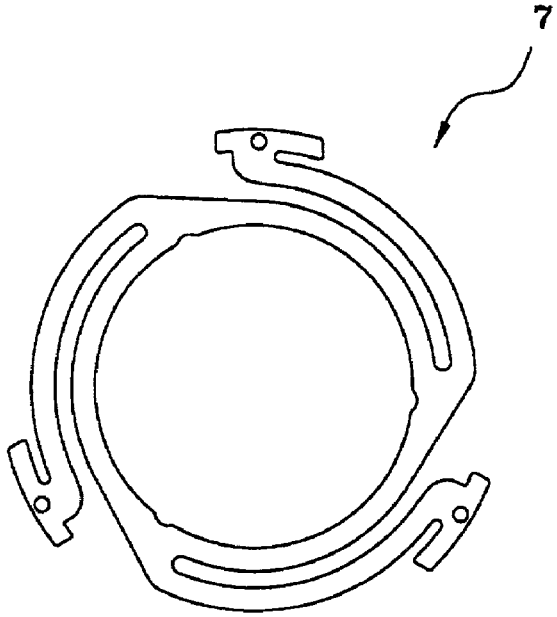
FIG. 3 shows a typical leaf spring.
Figure 4:
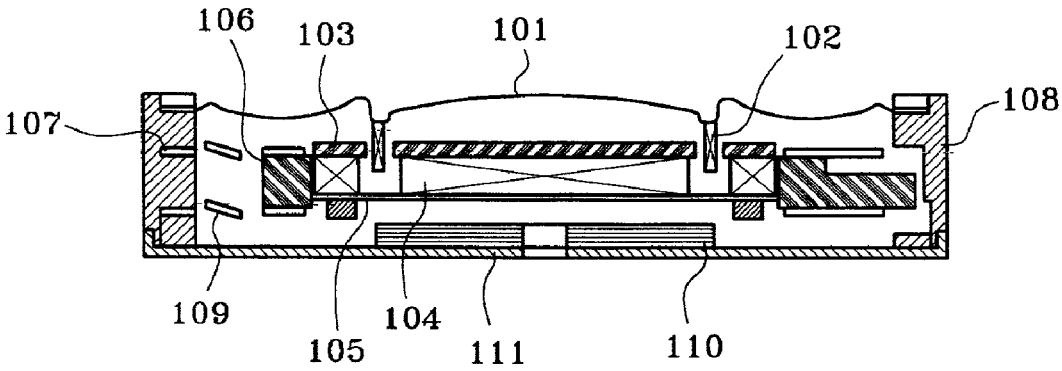
FIG. 4 is a sectional view of a multi-functional actuator according to the first embodiment of the invention.

As shown in FIG. 4, the multi-functional actuator of the invention comprises a housing 108 having an internal space and grooves in the inner side; a sound-generating diaphragm 101 with an outer end fixed to the upper end of the housing 108; a voice coil 102 fixed to the bottom of the diaphragm 101; a vertically magnetized magnet 104; an upper yoke 103 and a lower yoke 105 attached to the magnet 104 for forming a magnet circuit together with the magnet 104; a weight 106 for defining a vibration body; leaf springs 107 and 109 fixed into the grooves of the housing 108 and having portions of curvature; and a vibrating coil 110 installed in the housing 108 for generating vibration using the magnetic flux formed in the magnetic system.

Figure 5:
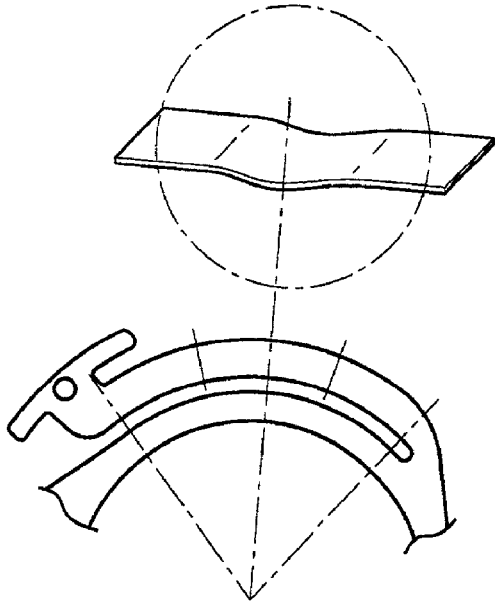
FIGS. 5 and 6 are perspective views of leaf springs of the invention.

In particular, as shown in FIG. 5, the invention provides portions of curvature in outer portions in an elastic portion of the leaf springs as a preferred embodiment, since the bends at portions for mainly exerting an elastic force enable effective endurance against a moment.

Further, the springs of the invention are characterized in having portions of curvature in the circumferential direction, which also enables effective endurance against the moment. The springs can have at least one of the foregoing portions of curvature, and alternatively in plural number along the circumferential direction of the spiral springs.

Figure 6:
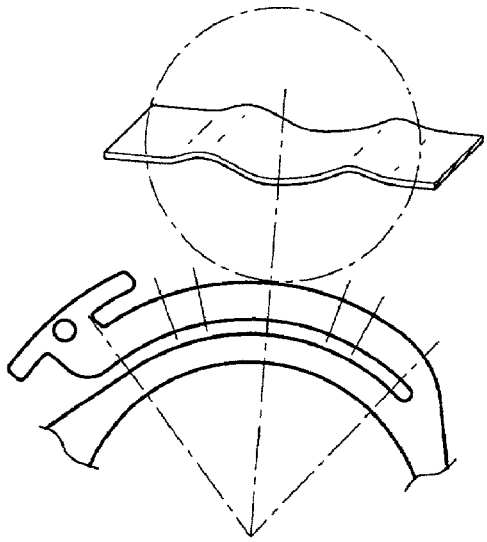

FIG. 5 shows one bend existing in an elastic portion of the spring, and FIG. 6 shows two portions of curvature existing in the elastic portion of the spring.

Figure 7:
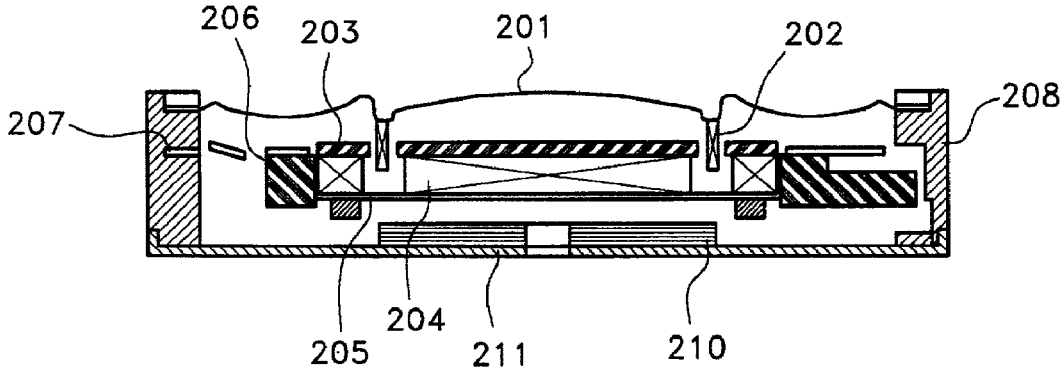
FIG. 7 is a sectional view of a multi-functional actuator according to the second embodiment of the invention.

While FIG. 4 shows the multi-functional actuator having the pair of leaf springs in upper and lower ones according to the first embodiment of the invention, FIG. 7 shows another multi-functional actuator having a single leaf spring according to the second embodiment of the invention, in which portions of curvature of the leaf spring in the second embodiment has the configuration shown in FIGS. 5 and 6 as those of the leaf springs in the first embodiment. In other words, the portion of curvature is provided in single number or plural number in the circumferential direction in portions for exerting an elastic force in outer portions of the spiral-shaped spring (hereinafter will be referred to as 'elastic portion' and also called as leg of spring).

Hereinafter detailed description will be made about the operations of the embodiments in reference to FIG. 4.

When a high-frequency of AC current is externally applied through a lead line (not shown) to the voice coil 102 in the magnetic system constituted by the upper plate 103, the vertically magnetized magnet 104 and the yoke 105, an electromagnetic force is generated to cause a vertical motion to the voice coil 102, in which the diaphragm 101 attached to the one end of the voice coil 102 is minutely vibrated while generating sound.

Also, when an AC current is applied to the vibration-generating coil 110 placed on the grill 111 at the bottom of the housing 108, the magnetic flux leaking from the magnetic system constituted by the magnet 104 and yokes 103, 105 generates attractive and repulsive forces to vibrate the vibration mass including the weight 106. Such vibration is transferred to the housing 108 through the leaf springs 107 and 109 which are separately connected in the upper and lower positions.

In order to prevent vibration features influenced by the mass and spring constant from being varied by an external impact or pressure which are abruptly applied in such a multi-functional actuator, the embodiments of the invention provides the leaf spring surface with the bends, which enables endurance against the rotational moment in the peripheral direction and against an impact caused by dropping of the leaf spring.

The portions of curvature existing as above in the elastic portions in the outer portions of the spiral portions of the leaf spring exert the elastic force to prevent deformation by the rotational moment M of the spring, which can be observed through an experiment by a simple modeling of a common cantilever as follows.

Figure 8:
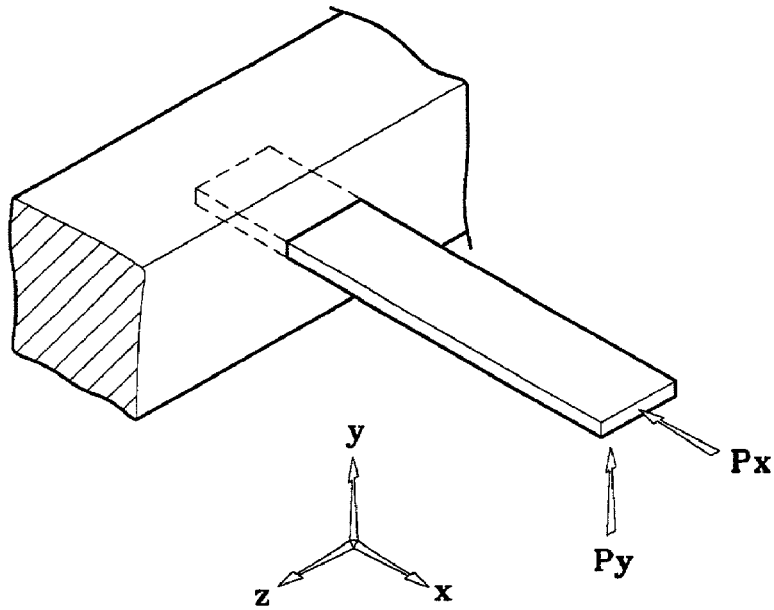
FIGS. 8 and 9 are conceptual view for modeling an external force acting on a leaf spring.
Figure 9:
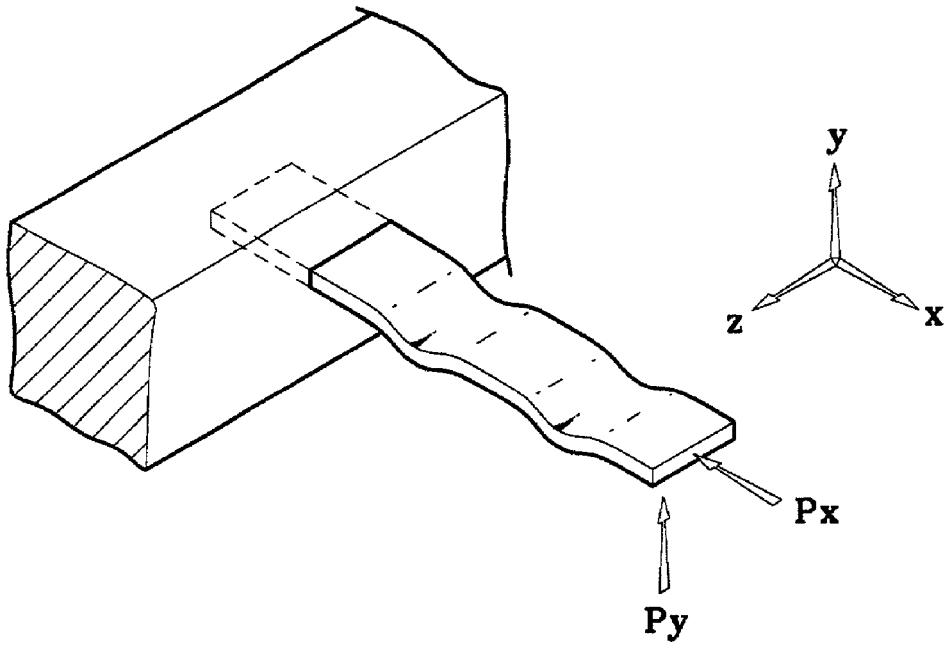

The rotational moment M in the actuator of the invention acts as an external force P to the spring end, and is decomposed into a horizontal force $P_x$ of a horizontal component and a vertical force $P_y$ of a vertical component, which are modeled as can be seen in FIGS. 8 and 9.

FIG. 8 shows a modeled leaf spring of the prior art structure. When the external force P is applied to a leaf spring, the leaf spring exerts an elastic force against only the force $P_y$, a vertical component of the external force P, but it is deformed by the force $P_x$, a horizontal component of the external force P. Meanwhile, if the spring is provided with the bends as shown in FIG. 9, the leaf spring can exert an elastic force against said horizontal component $P_x$ as well as the vertical component $P_y$, so that a deformation of the spring is prevented. It is because a restoring force due to an elastic force is increased.

Figure 10:
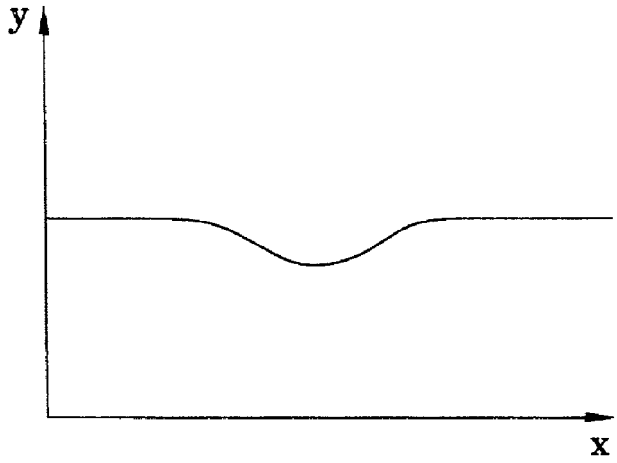
FIG. 10 shows a waved shaped portion of curvature of a leaf spring of the invention.
Figure 11:
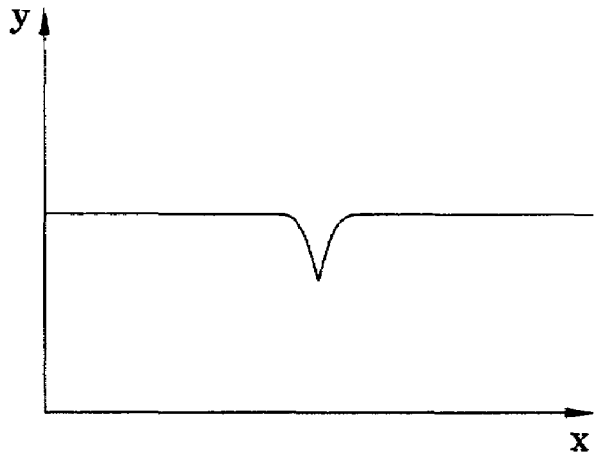
FIG. 11 shows a pointed shaped portion of curvature of a leaf spring of the invention.

The portion of curvature can be realized in various shapes in the invention. For example, a curve that the portion of curvature makes in a plane defined by the x-axis and the y-axis shown in FIG. 9 can be sinusoidal function as a wave form, shown in FIG. 10. Also it can be executed in the curve of a sharp shape, shown in FIG. 11.

Figure 12:
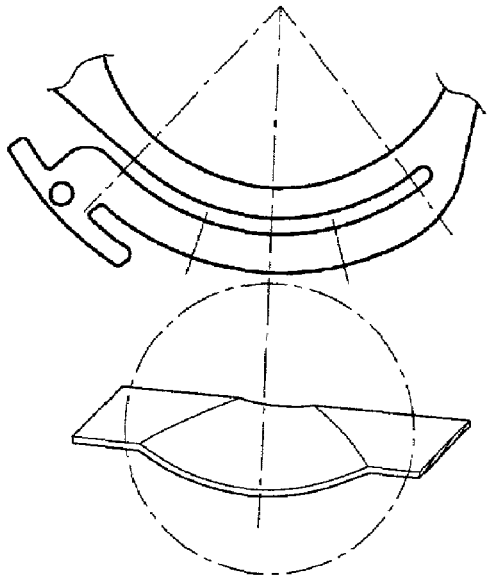
FIGS. 12 and 13 respectively show a portion of curvature flexed in a outer circumferential portion in an elastic portion of a leaf spring of the invention.
Figure 13:
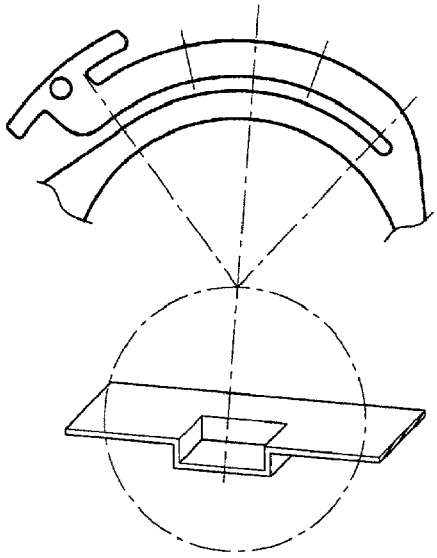

Further, the portion of curvature can be obtained as shown in FIGS. 12 and 13 characterized in that an outer circumferential portion in the leaf spring is bent in a radial direction, in which the bending portion and the adjacent right and left ends are smoothly shaped or linearly shaped with edges. FIGS. 12 and 13 respectively show that the shape of the bending is smoothly shaped or linearly shaped with edges.

In addition to the portion of curvature due to bending on the same plane as shown above, the spring can be realized in such a fashion, like a möbius band, that a portion of the spring surface facing upward is twisted in respect to the elastic portion so that the facing direction of the surface is varied thereby defining a twisting portion. In particular, the twisting portion allows a more stable function of the spring to be expected to absorb a force in the z-direction as shown in FIG. 9.

Figure 14:
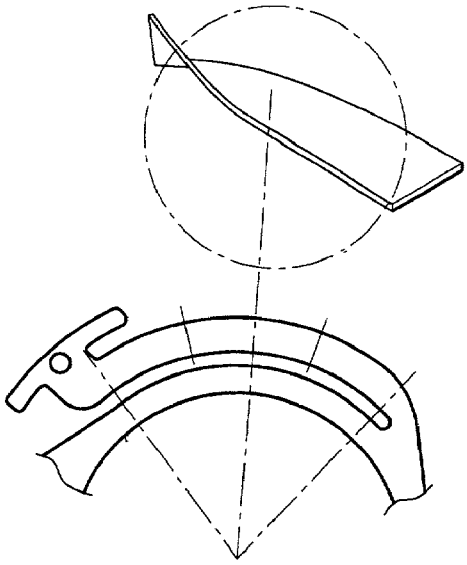
FIG. 14 shows a twisted portion due to twisting of a leaf spring.

FIG. 14 shows the portion of curvature twisted according to the invention.

Hereinafter further various embodiment of the invention is described.

The multi-functional actuator according to a third embodiment of the invention is comprised of a housing having an internal space in the inner side; a coil installed in said housing; a magnet; a yoke for forming the magnetic circuit together with said magnet; and at least one leaf spring fixed in the housing and having a portion of curvature.

Figure 15:
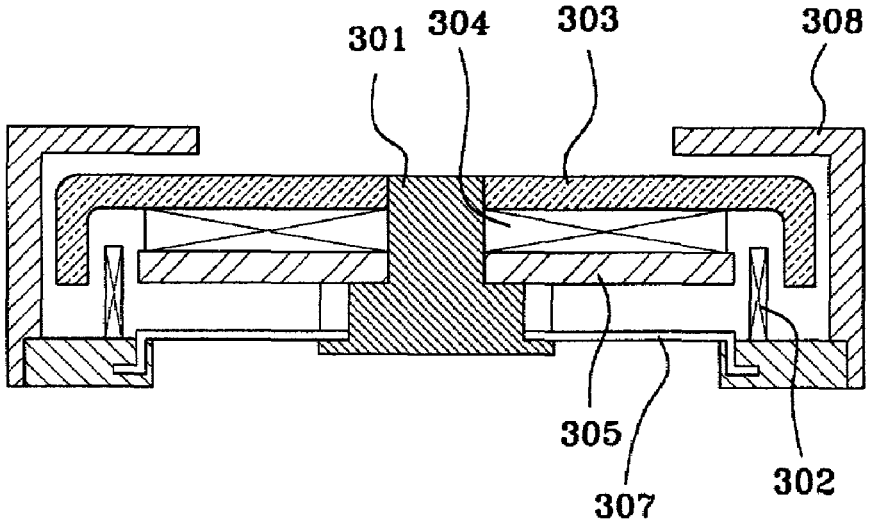
FIG. 15 is a sectional view of a multi-functional actuator according to the third embodiment of the invention.

FIG. 15 is a sectional view of a multi-functional actuator according to the third embodiment of the invention. Herein after detailed description will be made about the operations of the third embodiment in reference to FIG. 15.

When a high-frequency of AC current is externally applied through a lead line (not shown) to the coil 302 in the magnetic system constituted by the upper yoke 303, the magnetized magnet 304 and the lower yoke 305, an electromagnetic force is generated to cause a vertical motion to the coil 302, in which the coil 302 is minutely vibrated while generating sound.

Also, when a low-frequency of AC current is applied, the coil 302 in the magnetic system constituted by the magnetized magnet 304, the upper yoke 303 and the lower yoke 305 is vibrating and this vibration is transmitted to a supporting body 301 by the leaf spring 307 connected to the housing.

In order to prevent vibration features influenced by the mass and spring constant from being varied by an external impact or pressure which are abruptly applied in such a multi-functional actuator, the embodiments of the invention provides the leaf spring surface with the bends, which enables endurance against the rotational moment in the peripheral direction and against an impact caused by dropping of the leaf spring.

The portion of curvature of the leaf spring in the third embodiment of the multi-functional actuator according to the invention is located in the elastic portions in the outer portions of the portions of the leaf spring, therefore, an advanced elastic force can be exerted by the portion of curvature of the leaf spring so that a deformation due to a rotational moment is prevented, as described above the first and second embodiments.

Also, the portion of curvature of the leaf spring is located in the circumferential direction and can be embodied in various types, as described above the first and second embodiments.

Therefore, the portion of curvature of the leaf spring can be a bending portion or a twisting portion.

If the portion of curvature of the leaf spring is a bending portion, said bending portion can be waved or sharp shaped, as described above the first and second embodiments. Therefore repeated description is emitted in the invention.

The bending portion of the leaf spring is radially bent in an outer circumferential portion of said leaf spring, and smoothly shaped at the bending portion and the adjacent right and left ends. And also, said bending portion of the leaf spring is radially bent in an outer circumferential portion of said leaf spring, and linearly shaped at the bending portion and the adjacent right and left ends. These features are similar to the first and second embodiments. Therefore repeated description is emitted in the invention.

A multi-functional actuator according to a fourth embodiment of the invention can be comprised of a housing having an internal space in the inner side; a sound-generating diaphragm with an outer end fixed to the upper end of said housing; a coil fixed to the bottom of said diaphragm; a magnet; a yoke for forming the magnetic circuit together with said magnet; and at least one leaf spring fixed in the housing and having a portion of curvature.

Figure 16:
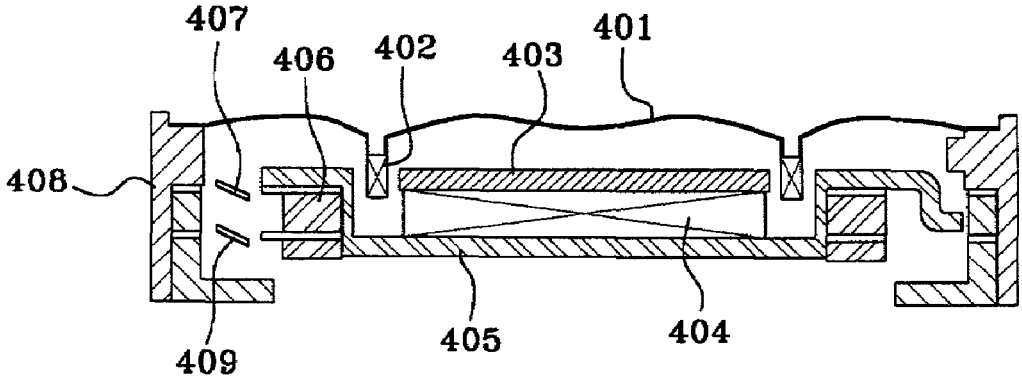
FIG. 16 is a sectional view of a multi-functional actuator according to the fourth embodiment of the invention.

FIG. 16 shows a sectional view of a multi-functional actuator according to the fourth embodiment of the invention.

Herein after detailed description will be made about the operations of the fourth embodiment in reference to FIG. 16.

When a high-frequency of AC current is externally applied through a lead line (not shown) to the coil 402 in the magnetic system constituted by the upper yoke 403, the magnetized magnet 404 and the lower yoke 405, an electromagnetic force is generated to cause a vertical motion to the coil 402, in which the diaphragm 401 attached to the end of the coil 402 is minutely vibrated while generating sound.

Also, when a low-frequency of AC current is applied, the magnetic flux leaking from the magnetic system constituted by the magnet 404 and yokes 403, 405 generates attractive and repulsive forces to vibrate the vibration mass including the weight 406. Such vibration is transferred to the housing 108 through the leaf springs 407 and 409, which are separately connected in the upper and lower positions.

In order to prevent vibration features influenced by the mass and spring constant from being varied by an external impact or pressure which are abruptly applied in such a multi-functional actuator, the embodiments of the invention provides the leaf spring surface with the bends, which enables endurance against the rotational moment in the peripheral direction and against an impact caused by dropping of the leaf spring.

Also, a portion of curvature of the leaf spring in the fourth embodiment of the multi-functional actuator according to the invention is located in the elastic portions in the outer portions of the portions of the leaf spring, therefore, an advanced elastic force can be exerted by the portion of curvature of the leaf spring so that a deformation due to a rotational moment is prevented, as described above embodiments.

The portion of curvature of the leaf spring in a fourth embodiment of the multi-functional actuator according to the invention can be executed in various types, as above embodiments. Therefore repeated description is emitted in the invention.

The invention provides a structure that can prevent reliability degradation and maintain the vibration features of the inner leaf spring against any abrupt impact or force externally applied to the multi-functional actuator thereby enhancing reliability of the actuator in use for mobile communication terminals.

It should be understood that the foregoing structure is only by way of example in embodying the invention and that numerous variations and modification may be made by those skilled in the art from the scope and basic spirit of the invention described in the claims of the invention.

What is claimed is:

1. A multi-functional actuator comprising:

a housing having an internal space and a groove in the inner side;

a sound-generating diaphragm with an outer end fixed to the upper end of said housing;

a voice coil fixed to the bottom of said diaphragm;

a vertically magnetized magnet;

an upper plate attached to said magnet for forming a magnet circuit;

a yoke for forming the magnetic circuit together with said magnet;

a weight for defining a vibration body together with said yoke;

a leaf spring fixed into said grooves of the housing and having a portion of curvature which is a bending portion radially bent in an outer circumferential portion of said leaf spring; and a vibrating coil installed in said housing for generating vibration using a magnetic flux formed in a magnetic system.

2. The multi-functional actuator according to claim 1, wherein said leaf spring is provided in a pair, and at least one of said springs has the portion of curvature.

3. The multi-functional actuator according to claim 1, wherein said leaf spring is provided as one.

4. The multi-functional actuator according to claim 1, wherein said portion of curvature of the leaf spring is in elastic portions.

5. The multi-functional actuator according to claim 1, wherein said portion of curvature of the leaf spring is in the circumferential direction.

6. The multi-functional actuator according to claim 1, wherein said portion of curvature of the leaf spring is provided in plural number.

7. The multi-functional actuator according to claim 1, wherein said portion of curvature of the leaf spring is a twisting portion.

8. The multi-functional actuator according to claim 1, wherein said leaf spring is smoothly shaped at the bending portion and the adjacent right and left ends.

9. The multi-functional actuator according to claim 1, wherein said leaf spring is linearly shaped at the bending portion and the adjacent right and left ends.

10. A multi-functional actuator comprising:

a housing having an internal space in the inner side;

a coil installed in said housing;

a magnet;

a yoke for forming the magnetic circuit together with said magnet; and at least one leaf spring fixed in the housing and having a portion of curvature;

said portion of curvature of the leaf spring being a bending portion radially bent in an outer circumferential portion of said leaf spring.

11. The multi-functional actuator according to claim 10, wherein said portion of curvature of the leaf spring is in elastic portions.

12. The multi-functional actuator according to claim 10, wherein said portion of curvature of the leaf spring is in the circumferential direction.

13. The multi-functional actuator according to claim 10, wherein said portion of curvature of the leaf spring is a twisting portion.

14. The multi-functional actuator according to claim 10, wherein said leaf spring is smoothly shaped at the bending portion and the adjacent right and left ends.

15. The multi-functional actuator according to claim 10, wherein said leaf spring is linearly shaped at the bending portion and the adjacent right and left ends.

16. A multi-functional actuator comprising:

a housing having an internal space in the inner side;

a sound-generating diaphragm with an outer end fixed to the upper end of said housing;

a coil fixed to the bottom of said diaphragm;

a magnet;

a yoke for forming the magnetic circuit together with said magnet; and at least one leaf spring fixed in the housing and having a portion of curvature being a bending portion which is radially bent in an outer circumferential portion of said leaf spring.

17. The multi-functional actuator according to claim 16, wherein said portion of curvature of the leaf spring is in elastic portions.

18. The multi-functional actuator according to claim 16, wherein said portion of curvature of the leaf spring is in the circumferential direction.

19. The multi-functional actuator according to claim 16, wherein said portion of curvature of the leaf spring is a twisting portion.

20. The multi-functional actuator according to claim 16, wherein said leaf spring is smoothly shaped at the bending portion and the adjacent right and left ends.

21. The multi-functional actuator according to claim 16, wherein said leaf spring is linearly shaped at the bending portion and the adjacent right and left ends.

* * * * *